US011019432B2

(12) United States Patent
Ding et al.

(10) Patent No.: US 11,019,432 B2
(45) Date of Patent: May 25, 2021

(54) SPEAKER UNIT, SPEAKER, TERMINAL, AND SPEAKER CONTROL METHOD

(71) Applicant: Huawei Technologies Co., Ltd., Shenzhen (CN)

(72) Inventors: Jun Ding, Shenzhen (CN); Dahe Kou, Shenzhen (CN); Bin Du, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/492,789

(22) PCT Filed: Jun. 30, 2017

(86) PCT No.: PCT/CN2017/091170
§ 371 (c)(1),
(2) Date: Sep. 10, 2019

(87) PCT Pub. No.: WO2018/161475
PCT Pub. Date: Sep. 13, 2018

(65) Prior Publication Data

US 2020/0059728 A1 Feb. 20, 2020

(30) Foreign Application Priority Data

Mar. 10, 2017 (CN) ..... 201710142493.6

(51) Int. Cl.
*H04R 9/06* (2006.01)
*H04R 1/28* (2006.01)

(52) U.S. Cl.
CPC ..... *H04R 9/06* (2013.01); *H04R 1/2834* (2013.01)

(58) Field of Classification Search
CPC ..... H04R 1/2834; H04R 9/06; H04R 9/063; H04R 9/047; H04R 31/006; H04R 2499/11
See application file for complete search history.

(56) References Cited

U.S. PATENT DOCUMENTS 6,373,958 B1 4/2002 Enomoto et al.
7,961,892 B2 * 6/2011 Fedigan ..... H04R 9/063 381/59

(Continued)

FOREIGN PATENT DOCUMENTS

CN 1273541 A 11/2000
CN 202713603 U 1/2013

(Continued)

OTHER PUBLICATIONS

Machine Translation and Abstract of Chinese Publication No. CN104113803, Oct. 22, 2014, 12 pages.

(Continued)

*Primary Examiner* — Brian Ensey
(74) *Attorney, Agent, or Firm* — Conley Rose, P.C.

(57) ABSTRACT

A speaker includes a frame, a magnet, a diaphragm, a first coil, and a second coil assembly. The second coil assembly includes at least one second coil group, and each second coil group includes two second coils. The magnet and the diaphragm are mounted on the frame. The first coil and each second coil are coupled to the diaphragm. The first coil is configured to drive the diaphragm to vibrate. The second coil assembly is configured to, when the diaphragm vibrates and a difference between vibration displacements of two vibration regions in the diaphragm that are correspondingly coupled to two second coils in any second coil group exceeds a preset threshold, drive at least one of the two (Continued)

vibration regions to move to reduce the difference between the vibration displacements of the two vibration regions.

20 Claims, 11 Drawing Sheets

(56) References Cited

U.S. PATENT DOCUMENTS

| | | | | |
|---|---|---|---|---|
| 10,034,109 | B2 * | 7/2018 | Russell | H04R 29/003 |
| 2008/0205687 | A1 | 8/2008 | Vincent et al. | |
| 2018/0115833 | A1 | 4/2018 | Hui et al. | |

FOREIGN PATENT DOCUMENTS

| | | | |
|---|---|---|---|
| CN | 103763664 | A | 4/2014 |
| CN | 104113803 | A | 10/2014 |
| CN | 205454082 | U | 8/2016 |
| CN | 106303883 | A | 1/2017 |
| CN | 106792401 | A | 5/2017 |
| CN | 206149494 | U | 5/2017 |
| JP | 2008072482 | A | 3/2008 |

OTHER PUBLICATIONS

Machine Translation and Abstract of Japanese Publication No. JP2008072482, Mar. 27, 2008, 32 pages.

Machine Translation and Abstract of Chinese Publication No. CN103763664, Apr. 30, 2014, 11 pages.

Machine Translation and Abstract of Chinese Publication No. CN205454082, Aug. 10, 2016, 9 pages.

Machine Translation and Abstract of Chinese Publication No. CN106303883, Jan. 4, 2017, 14 pages.

Machine Translation and Abstract of Chinese Publication No. CN106792401, May 31, 2017, 16 pages.

Foreign Communication From a Counterpart Application, Chinese Application No. 201780022682.8, Chinese Office Action dated Jul. 25, 2019, 7 pages.

Foreign Communication From a Counterpart Application, PCT Application No. PCT/CN2017/091170, English Translation of International Search Report dated Nov. 3, 2017, 2 pages.

Foreign Communication From a Counterpart Application, PCT Application No. PCT/CN2017/091170, English Translation of Written Opinion dated Nov. 3, 2017, 4 pages.

* cited by examiner

SPEAKER UNIT, SPEAKER, TERMINAL, AND SPEAKER CONTROL METHOD

CROSS-REFERENCE TO RELATED APPLICATIONS

This application is a U.S. national stage application of International Patent Application No. PCT/CN2017/091170 filed on Jun. 30, 2017, which claims priority to Chinese Patent Application No. 201710142493.6 filed on Mar. 10, 2017. Both of the aforementioned applications are hereby incorporated by reference in their entireties.

TECHNICAL FIELD

This application relates to the field of acoustic technologies, and in particular, to a speaker unit, a speaker, a terminal, and a speaker control method.

BACKGROUND

Currently, in mobile terminals such as mobile phones and tablet computers, miniature speakers are used to output sound. A core element that is in a miniature speaker and that is used to generate sound is a speaker unit. According to different sound generation principles, common speaker units are classified into moving coil speaker units, balanced armature speaker units, flat panel speaker units, and the like. Currently, in a common miniature speaker in a mobile terminal, a moving coil speaker unit is usually used to generate sound. A structure of a common moving coil speaker unit is shown in FIG. 1. The structure includes a diaphragm 01, a coil 02 connected to the diaphragm 01, a magnet 03 disposed on one side of the diaphragm 01, and a frame 04 configured to mount the diaphragm 01 and the magnetic member 03. The coil 02 generates an induced magnetic field after being energized, so that the coil 02 displaces under action of a magnetic force of the magnet 03, to drive the diaphragm 01 to vibrate. When vibrating, the diaphragm 01 pushes air in front of the diaphragm 01 to form sound waves.

In an ideal working state of the moving coil speaker unit, when the diaphragm 01 is driven by the coil 02 to vibrate, a vibration direction of each part of the diaphragm 01 is the same as a vibration direction of the coil 02. Referring to FIG. 2*a*, the diaphragm 01 vibrates in an initial state A, and when the initial state A is changed into a state A' or a state A", the vibration direction of each part of the diaphragm 01 is the same as the vibration direction of the coil 02. However, in an actual working state of the moving coil speaker unit, unbalanced vibration of the diaphragm usually occurs due to unbalanced atmospheric pressure on two sides of the diaphragm and the like. To be specific, magnitudes or directions of vibration displacements of two parts of the diaphragm that are symmetrical about a center of the diaphragm, and details are shown in FIG. 2*b* and FIG. 2*c*. In FIG. 2*b*, the diaphragm 01 vibrates in an initial state A, and when the initial state A is changed into a state B, the directions of the vibration displacements of the two symmetrical parts of the diaphragm 01 are opposite. In FIG. 2*c*, the diaphragm 01 vibrates in an initial state A, and when the initial state A is changed into a state C, the directions of the vibration displacements of the two symmetrical parts of the diaphragm 01 are the same but the magnitudes of the vibration displacements are different. The unbalanced vibration causes distortion of sound emitted by the moving coil speaker unit, and as a result, sound quality of the speaker is degraded. Particularly, most of the commonly used miniature speakers have a side sound emission structure. To be specific, an opening direction of a sound emission hole of a miniature speaker is parallel to a plane in which a diaphragm lies. The miniature speaker having such a structure is more susceptible to unbalanced atmospheric pressure on two sides of the diaphragm when the diaphragm vibrates. As a result, a probability that sound distortion occurs in the miniature speaker is increased. When a user makes a call or plays music or a video by using a mobile terminal product such as a mobile phone or a tablet computer, use experience of the user is degraded due to sound distortion of the speaker.

SUMMARY

Embodiments of this application provide a speaker unit, a speaker, a terminal, and a speaker control method.

According to a first aspect, this application provides a speaker unit, including a frame, a magnet, a diaphragm, a first coil, and a second coil assembly, where the second coil assembly includes at least one second coil group, and each second coil group includes two second coils; the magnet and the diaphragm are connected to the frame; the first coil and each second coil are connected to the diaphragm; and in the second coil assembly, the two second coils in each second coil group are distributed symmetrically about a center of the diaphragm as a center of symmetry, and all the second coils in the second coil assembly are evenly distributed around the center of the diaphragm.

The speaker unit includes the first coil and the second coil assembly, the second coil assembly includes the at least one second coil group, each second coil group includes two second coils, and the first coil and each second coil are connected to the diaphragm. When an unbalanced vibration problem exists in the diaphragm, a drive current may be input to a second coil connected to a region that is in the diaphragm and in which an unbalanced vibration phenomenon occurs, so that the second coil drives a part of the diaphragm that is connected to the second coil to move. Therefore, an amplitude of unbalanced vibration of the part of the diaphragm is reduced, thereby alleviating a sound distortion problem of a speaker that is caused by the unbalanced vibration, and improving use experience of a user.

With reference to the first aspect, in a first possible implementation of the first aspect, each second coil includes a detection coil and a drive coil, and the detection coil is configured to output an induced current, to detect at least one of a magnitude or a direction of a vibration displacement of a corresponding vibration region; the drive coil is configured to input a drive current, to drive the corresponding vibration region to move; and the vibration region is a region that is in the diaphragm and that is connected to the second coil.

According to the foregoing implementation, for each second coil, at least one of the magnitude or the direction of the vibration displacement of the corresponding vibration region may be determined by using the induced current output by the detection coil of the second coil, to determine an actual location of the corresponding vibration region, and each second coil may further drive, by using the drive current input to the drive coil of the second coil, the corresponding vibration region to move, to adjust the location of the vibration region.

With reference to the first aspect, in a second possible implementation of the first aspect, when the second coil assembly includes at least two groups of second coils, some second coils in the second coil group are configured to detect at least one of a magnitude or a direction of a vibration displacement of a vibration region correspondingly connected to the second coils, and the other second coils in the second coil group are configured to drive the vibration region correspondingly connected to the second coils to move; and the vibration region is a region that is in the diaphragm and that is connected to the second coils.

According to the foregoing implementation, at least one of the magnitude or the direction of the vibration displacement of the corresponding vibration region may be determined by using an induced current output by the some second coils, to determine an actual location of the corresponding vibration region, and a drive current may further be input to the other second coils, to drive the corresponding vibration region to move, to adjust the location of the vibration region.

With reference to the first aspect, the first possible implementation of the first aspect, and the second possible implementation of the first aspect, in a third possible implementation of the first aspect, each second coil is a flexible conducting layer coil formed on the diaphragm.

According to the foregoing implementation, the flexible conducting layer coil has a lightweight, a small volume, and flexibility. Therefore, impact of the second coil on vibration performance of the diaphragm is reduced.

With reference to the third possible implementation of the first aspect, in a fourth possible implementation of the first aspect, a flexible conducting layer of each second coil is formed on the diaphragm by using a flexible circuit board printing process or a micro-processing process.

According to the foregoing implementation, the flexible conducting layer coil may be formed on the diaphragm.

With reference to the first aspect, the first possible implementation of the first aspect, and the second possible implementation of the first aspect, in a fifth possible implementation of the first aspect, each second coil is a coil formed by winding a conducting wire.

According to the foregoing implementation, a process of forming the coil by winding the conducting wire is relatively simple, so that a manufacturing process of the second coil is simplified.

With reference to the first aspect, the first possible implementation of the first aspect, the second possible implementation of the first aspect, the third possible implementation of the first aspect, the fourth possible implementation of the first aspect, and the fifth possible implementation of the first aspect, in a sixth possible implementation of the first aspect, the diaphragm includes a surround portion and a central portion located in the surround portion, and the first coil and each second coil are disposed in the central portion.

According to the foregoing implementation, rigidity of the diaphragm is improved by using the surround portion, thereby reducing a probability that unbalanced vibration occurs in the diaphragm.

With reference to the sixth possible implementation of the first aspect, in a seventh possible implementation of the first aspect, each second coil in the second coil assembly is disposed in a region enclosed by the first coil.

According to the foregoing implementation, when an unbalanced vibration problem occurs in a part of the diaphragm that is in the region enclosed by the first coil, the unbalanced vibration problem of the diaphragm in the region enclosed by the first coil is alleviated by using the second coil.

With reference to the sixth possible implementation of the first aspect, in an eighth possible implementation of the first aspect, each second coil in the second coil assembly is disposed outside a region enclosed by the first coil.

According to the foregoing implementation, when an unbalanced vibration problem occurs in a part of the diaphragm that is outside the region enclosed by the first coil, the unbalanced vibration problem of the diaphragm outside the region enclosed by the first coil is alleviated by using the second coil.

With reference to the sixth possible implementation of the first aspect, in a ninth possible implementation of the first aspect, when the second coil assembly includes at least two groups of second coils, second coils in some second coil groups are disposed in a region enclosed by the first coil, and second coils in the other second coil groups are disposed outside the region enclosed by the first coil.

According to the foregoing implementation, when an unbalanced vibration problem occurs in a part of the diaphragm that is in and outside the region enclosed by the first coil, the unbalanced vibration problem of the diaphragm in and outside the region enclosed by the first coil is alleviated by using the second coil.

With reference to the sixth possible implementation of the first aspect, in a tenth possible implementation of the first aspect, the central portion has a planar structure or a dome structure.

According to the foregoing implementation, when the central portion has the planar structure, a structure of the diaphragm is relatively simple, thereby simplifying a manufacturing process of the diaphragm. When the central portion has the dome structure, the rigidity of the diaphragm can be further improved, thereby reducing the probability that unbalanced vibration occurs in the diaphragm.

With reference to the sixth possible implementation of the first aspect, in an eleventh possible implementation of the first aspect, the diaphragm has a circular structure, a rectangular structure, or an elliptical structure; the first coil has a circular structure, a rectangular structure, or an elliptical structure; and each second coil has a circular structure, a rectangular structure, or an elliptical structure.

According to the foregoing implementation, the diaphragm, the first coil, and the second coil having required shapes may be set based on requirements of a volume and a structure of the speaker unit.

With reference to the first aspect, the first possible implementation of the first aspect, the second possible implementation of the first aspect, the third possible implementation of the first aspect, the fourth possible implementation of the first aspect, the fifth possible implementation of the first aspect, the sixth possible implementation of the first aspect, the seventh possible implementation of the first aspect, the eighth possible implementation of the first aspect, the ninth possible implementation of the first aspect, the tenth possible implementation of the first aspect, and the eleventh possible implementation of the first aspect, in a twelfth possible implementation of the first aspect, an area of a region enclosed by each second coil is smaller than an area of the region enclosed by the first coil.

According to the foregoing implementation, when the area of the region enclosed by the second coil is smaller than the area of the region enclosed by the first coil, a contact area between the second coil and the diaphragm is relatively small, thereby reducing impact of the second coil on a vibration characteristic of the diaphragm.

With reference to the first aspect, the first possible implementation of the first aspect, the second possible implementation of the first aspect, the third possible implementation of the first aspect, the fourth possible implementation of the first aspect, the fifth possible implementation of the first aspect, the sixth possible implementation of the first aspect, the seventh possible implementation of the first aspect, the eighth possible implementation of the first aspect, the ninth possible implementation of the first aspect, the tenth possible implementation of the first aspect, the eleventh possible implementation of the first aspect, and the twelfth possible implementation of the first aspect, in a thirteenth possible implementation of the first aspect, the second coil assembly includes one to five second coil groups.

According to the foregoing implementation, a required quantity of second coil groups may be set based on a distribution status of vibration regions that are in the diaphragm and in which unbalanced vibration may occur, thereby further alleviating the unbalanced vibration problem of the diaphragm.

With reference to the first aspect, the first possible implementation of the first aspect, the second possible implementation of the first aspect, the third possible implementation of the first aspect, the fourth possible implementation of the first aspect, the fifth possible implementation of the first aspect, the sixth possible implementation of the first aspect, the seventh possible implementation of the first aspect, the eighth possible implementation of the first aspect, the ninth possible implementation of the first aspect, the tenth possible implementation of the first aspect, the eleventh possible implementation of the first aspect, the twelfth possible implementation of the first aspect, and the thirteenth possible implementation of the first aspect, in a fourteenth possible implementation of the first aspect, the magnet includes at least one magnetic member.

According to the foregoing implementation method, the magnetic member in the magnet may generate a constant magnetic field, to implement driving of the first coil and the second coil, and outputting of the induced current in the second coil.

With reference to the fourteenth possible implementation of the first aspect, in a fifteenth possible implementation, each magnetic member is a permanent magnet or an electromagnet.

According to a second aspect, this application provides a speaker, including the speaker unit according to the first aspect, the first possible implementation of the first aspect, the second possible implementation of the first aspect, the third possible implementation of the first aspect, the fourth possible implementation of the first aspect, the fifth possible implementation of the first aspect, the sixth possible implementation of the first aspect, the seventh possible implementation of the first aspect, the eighth possible implementation of the first aspect, the ninth possible implementation of the first aspect, the tenth possible implementation of the first aspect, the eleventh possible implementation of the first aspect, the twelfth possible implementation of the first aspect, the thirteenth possible implementation of the first aspect, the fourteenth possible implementation of the first aspect, and the fifteenth possible implementation of the first aspect.

In the speaker, the speaker unit includes the first coil and the second coil assembly, the second coil assembly includes the at least one second coil group, each second coil group includes the two second coils, and the first coil and each second coil are connected to the diaphragm. When an unbalanced vibration problem exists in the diaphragm, a drive current may be input to a second coil connected to a region that is in the diaphragm and in which an unbalanced vibration phenomenon occurs, so that the second coil drives a part of the diaphragm that is connected to the second coil to move. Therefore, an amplitude of unbalanced vibration of the part of the diaphragm is reduced, thereby alleviating a sound distortion problem of the speaker that is caused by the unbalanced vibration, and improving use experience of a user.

According to a third aspect, this application provides a terminal, including the speaker according to the second aspect.

In the terminal, each speaker unit in the speaker includes the first coil and the second coil assembly, the second coil assembly includes the at least one second coil group, each second coil group includes two second coils, and the first coil and each second coil are connected to the diaphragm. When an unbalanced vibration problem exists in the diaphragm, a drive current may be input to a second coil connected to a region that is in the diaphragm and in which an unbalanced vibration phenomenon occurs, so that the second coil drives a part of the diaphragm that is connected to the second coil to move. Therefore, an amplitude of unbalanced vibration of the part of the diaphragm is reduced, thereby alleviating a sound distortion problem of the speaker that is caused by the unbalanced vibration, and improving use experience of a user.

According to a fourth aspect, this application provides a speaker control method, including:

inputting, when a difference between an actual vibration location and a theoretical vibration location of any vibration region in the diaphragm exceeds a preset first threshold, a drive current to a second coil correspondingly connected to the vibration region, so that the second coil drives the vibration region to move, to reduce the difference between the actual vibration location and the theoretical vibration location of the vibration region, where the vibration region is a region that is in the diaphragm and that is connected to the second coil; and the theoretical vibration location is a vibration location of each vibration region when the diaphragm is driven by the first coil to vibrate and a difference between vibration displacements of two vibration regions respectively correspondingly connected to two second coils in any second coil group does not exceed a preset second threshold.

According to the foregoing method, when the difference between the actual vibration location and the theoretical vibration location of any vibration region in the diaphragm exceeds the preset first threshold, it may be determined that unbalanced vibration occurs in the vibration region in the diaphragm, the drive current is input to the second coil correspondingly connected to the vibration region, so that the second coil drives the vibration region to move, to reduce the difference between the actual vibration location and the theoretical vibration location of the vibration region. Therefore, an unbalanced vibration problem in the vibration region in the diaphragm can be alleviated, thereby alleviating a sound distortion problem of a speaker that is caused by the unbalanced vibration, and improving use experience of a user.

With reference to the fourth aspect, in a first possible implementation of the fourth aspect, before the inputting, when a difference between an actual vibration location and a theoretical vibration location of any vibration region in the diaphragm exceeds a preset threshold, a drive current to a second coil correspondingly connected to the vibration region, the method further includes:

when the diaphragm vibrates, determining whether magnitudes and directions of induced currents in two second coils in any second coil group are the same, and if not, determining an actual vibration location of each vibration region correspondingly connected to each of the two second coils.

According to the foregoing method, when the induced currents in the two second coils in any second coil group are different in at least one of the magnitudes and the directions, it may be determined that unbalanced vibration occurs in two vibration regions that are in the diaphragm and that are corresponding to the two second coils, and the actual vibration location of the vibration region may continue to be determined.

With reference to the first possible implementation of the fourth aspect, in a second possible implementation of the fourth aspect, the determining an actual vibration location of each vibration region correspondingly connected to each of the two second coils specifically includes:

determining a magnitude of a vibration displacement of each vibration region based on the magnitude of the induced current in the second coil correspondingly connected to the vibration region:

determining a direction of the vibration displacement of each vibration region based on the direction of the induced current in the second coil correspondingly connected to the vibration region; and determining the actual vibration location of each vibration region based on the magnitude and the direction of the vibration displacement of the vibration region.

According to the foregoing method, the magnitude and the direction of the vibration displacement of the vibration region corresponding to the second coil may be determined by using the magnitude and the direction of the induced current in the second coil, to determine the actual vibration location of the vibration region.

With reference to the second possible implementation of the fourth aspect, in a third possible implementation of the fourth aspect, the determining a magnitude of a vibration displacement of each vibration region based on the magnitude of the induced current in the second coil correspondingly connected to the vibration region specifically includes:

determining a variation of magnetic flux in any second coil based on a magnitude of an induced current in the second coil;

determining a displacement amount of the second coil based on the variation of the magnetic flux in the second coil and magnetic field intensity distribution of a magnetic field in which the second coil is located; and determining, based on the displacement amount of the second coil, the magnitude of the vibration displacement of the vibration region correspondingly connected to the second coil.

According to the foregoing method, a magnitude of a displacement of the second coil may be determined based on the magnitude of the induced current, the variation of the magnetic flux, and the magnetic field intensity distribution of the second coil, to determine the magnitude of the vibration displacement of the vibration region corresponding to the second coil.

With reference to the second possible implementation of the fourth aspect, in a fourth possible implementation of the fourth aspect, the determining a direction of the vibration displacement of each vibration region based on the direction of the induced current in the second coil correspondingly connected to the vibration region specifically includes:

determining a speed direction of any second coil based on a direction of an induced current in the second coil and magnetic field intensity distribution of a magnetic field in which the second coil is located; and determining, based on the speed direction of the second coil, a direction of a vibration displacement of a vibration region correspondingly connected to the second coil.

According to the foregoing method, a direction of a displacement of the second coil may be determined based on the direction of the induced current and the magnetic field intensity distribution of the second coil, to determine the direction of the vibration displacement of the vibration region corresponding to the second coil.

With reference to the fourth aspect, the first possible implementation, the second possible implementation, the third possible implementation, and the fourth possible implementation of the fourth aspect, in a fifth possible implementation of the fourth aspect, the inputting a drive current to a second coil correspondingly connected to the vibration region specifically includes:

determining, based on a magnitude of an offset between the actual vibration location and the preset theoretical vibration location of the vibration region, a magnitude of the drive current input to the second coil correspondingly connected to the vibration region; and determining, based on a direction of the offset between the actual vibration location and the preset theoretical vibration location of the vibration region, a direction of the drive current input to the second coil correspondingly connected to the vibration region.

According to the foregoing method, the magnitude of the drive current input to the second coil corresponding to the vibration region may be determined based on the magnitude and the direction of the offset between the actual vibration location and the preset theoretical vibration location of the vibration region, so that the second coil drives the vibration region to move to the theoretical vibration location of the vibration region, to reduce an amplitude of the unbalanced vibration of the vibration region. Therefore, the unbalanced vibration problem in the vibration region in the diaphragm can be alleviated, thereby alleviating the sound distortion problem of the speaker that is caused by the unbalanced vibration, and improving the use experience of the user.

DESCRIPTION OF EMBODIMENTS

The following further describes the embodiments of this application in detail with reference to the accompanying drawings.

Embodiments of this application provide a speaker unit, a speaker, a terminal, and a speaker control method, to resolve a sound distortion problem of the speaker that is caused by unbalanced vibration in the prior art.

Some wordings in this application are explained below for ease of understanding by a person skilled in the art.

The term "a plurality of" refers to two or more. In addition, it should be understood that, in descriptions of this application, terms such as "first" and "second" are merely used for purposes of distinguishing descriptions and are neither intended to indicate or imply relative importance nor intended to indicate or imply a sequence.

Figure 1:
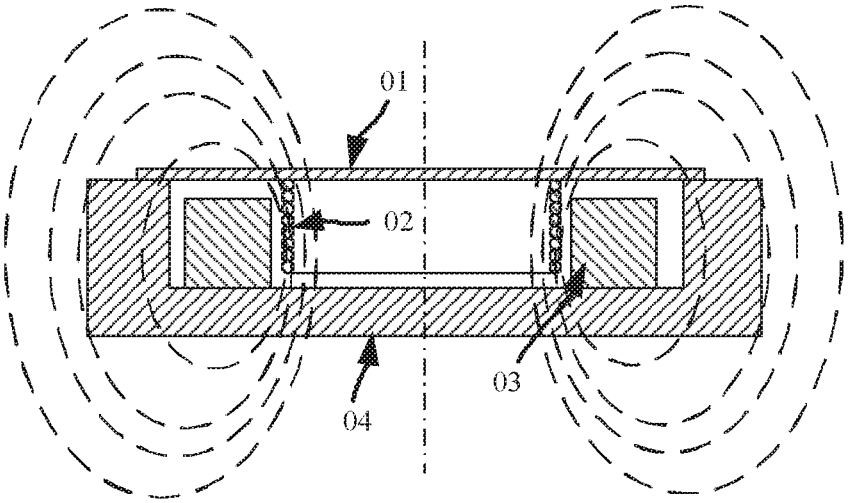
FIG. 1 is a schematic structural diagram of a moving coil speaker unit in the prior art.
Figure 2A:
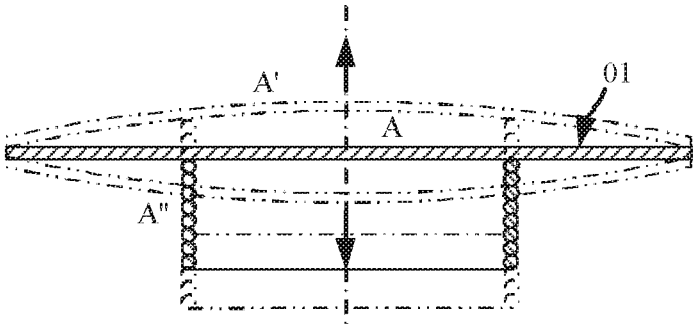
FIG. 2*a* is a diagram of a movement principle when unbalanced vibration does not occur in the speaker unit shown in FIG. 1.
Figure 2B:
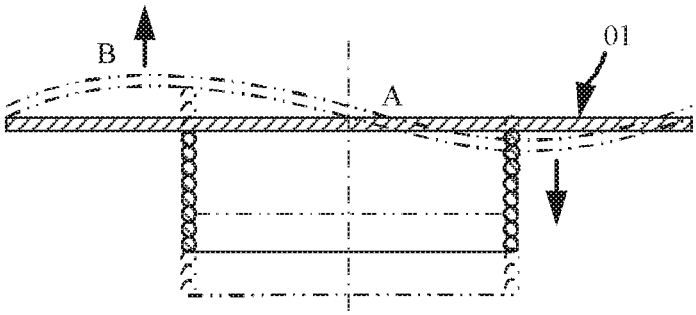
FIG. 2*b* is a diagram of a movement principle when unbalanced vibration occurs in the speaker unit shown in FIG. 1.
Figure 2C:
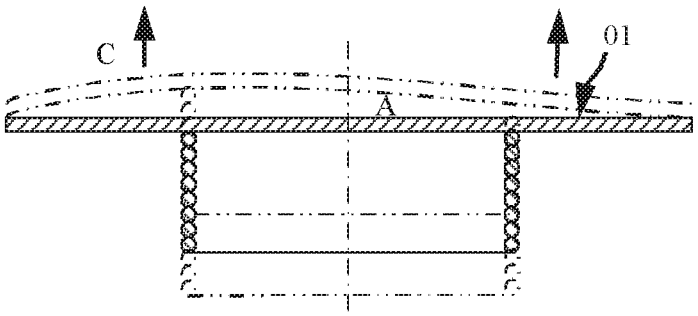
FIG. 2*c* is a diagram of a movement principle when another unbalanced vibration occurs in the speaker unit shown in FIG. 1.
Figure 3:
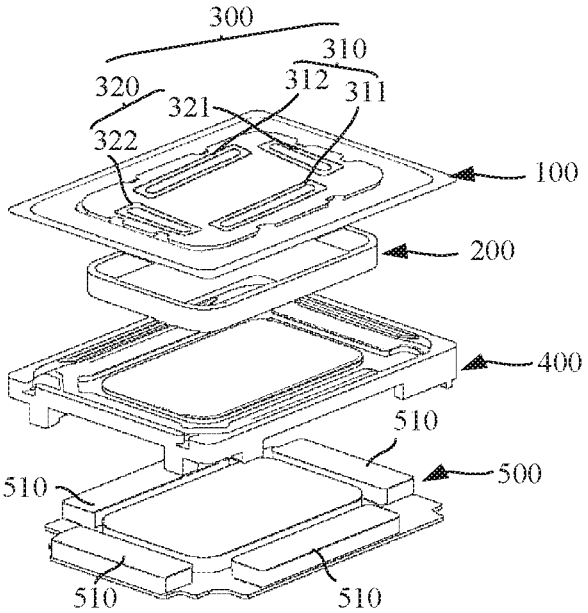
FIG. 3 is a schematic exploded structural diagram of a speaker unit according to an embodiment of this application.
Figure 4:
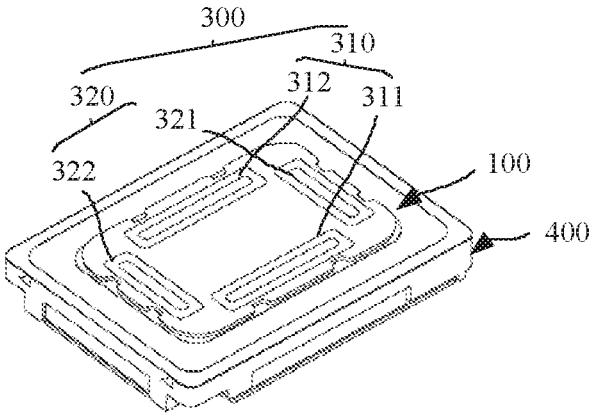
FIG. 4 is a schematic assembly structural diagram of a speaker unit according to an embodiment of this application.

FIG. 3 is a schematic exploded structural diagram of a speaker unit according to an embodiment of this application, and FIG. 4 is a schematic assembly structural diagram of a speaker unit according to an embodiment of this application. The speaker unit includes a diaphragm 100, a first coil 200, a second coil assembly 300, a frame 400, and a magnet 500. The second coil assembly 300 in the speaker unit shown in FIG. 3 includes two second coil groups, to be specific, a second coil group 310 and a second coil group 320. Each second coil group includes two second coils. To be specific, the second coil group 310 includes a second coil 311 and a second coil 312. The second coil group 320 includes a second coil 321 and a second coil 322. The first coil 200 and each second coil are connected to the diaphragm 100. The magnet 500 and the diaphragm 100 are separately connected to the frame 400. During specific implementation, the first coil 200 and each second coil may be separately connected to two sides of the diaphragm 100, or the first coil 200 and each second coil are connected to a same side of the diaphragm 100. In this embodiment of this application, whether the first coil and the second coil are located on a same side of the diaphragm is not limited.

Structures or functions of all components of the speaker unit are described below.

Frame: The frame supports the diaphragm and the magnet. A frame in a common speaker unit is usually made of plastic or metal, and a material of the frame is not limited in this embodiment of this application.

Magnet: The magnet is configured to generate a constant magnetic field having magnetic induction in the speaker unit. Usually, the constant magnetic field generated by the magnet is symmetrically distributed about a center of the diaphragm. The magnet may be made of a magnetic material such as ferrite, a neodymium magnet, or a strontium magnet, and a material of the magnet is not limited in this embodiment of this application.

Diaphragm: The diaphragm is an element that generates sound through vibration in a moving coil speaker unit. The diaphragm usually has a film form, and the diaphragm is usually made of paper, plastic, metal, a composite material, or the like. A material of the diaphragm is not limited in this embodiment of this application.

First coil: In this embodiment of this application, the first coil is a coil that drives the diaphragm to vibrate to generate sound. During specific implementation, the first coil may be connected to a first coil drive apparatus. The first coil drive apparatus is configured to input an audio signal to the first coil, and the audio signal is a varying current. It can be learned from an Ampere's force generation principle that the first coil generates a varying magnetic field around after being energized. A magnetic force is generated between the varying magnetic field generated by the first coil and the constant magnetic field of the magnet, to drive the first coil to move in the constant magnetic field, so that the first coil drives the diaphragm to vibrate to generate sound. In this embodiment of this application, the first coil may be a coil formed by winding a conducting wire, and the coil may be made of copper, aluminum, silver, alloy, or the like. The first coil may be alternatively a flexible conducting layer coil formed on the diaphragm, and the coil may be similarly made of copper, aluminum, silver, alloy, or the like. A structure and a material of the first coil are not limited in this embodiment of this application.

Figure 5:
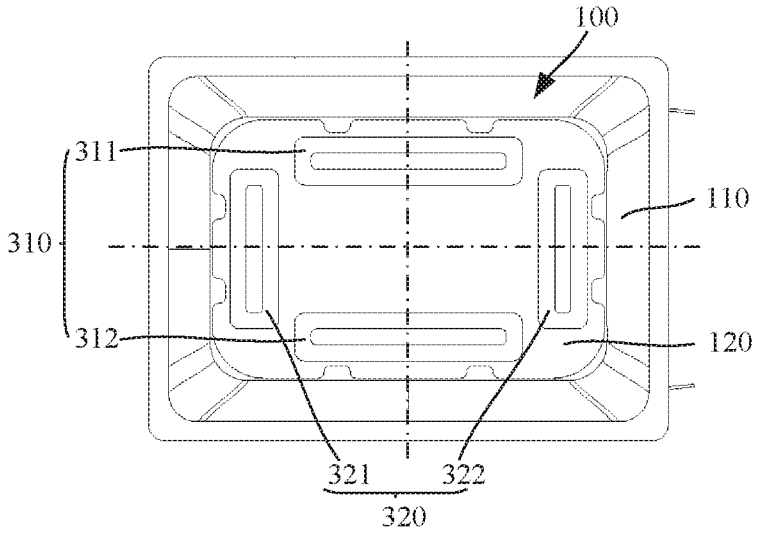
FIG. 5 is a schematic structural diagram of a diaphragm of the speaker unit according to an embodiment.

Second coil assembly: In this embodiment of this application, the second coil assembly includes two second coil groups. During specific implementation, there is at least one second coil group or there may be a plurality of second coil groups in the second coil assembly. Each second coil group includes two second coils. FIG. 5 is a schematic structural diagram of the diaphragm of the speaker unit according to this embodiment. The two second coils in each second coil group are distributed symmetrically about the center of the diaphragm as a center of symmetry, and all the second coils in the second coil assembly are evenly distributed around the center of the diaphragm. To keep two regions that are on two sides of the center of the diaphragm and that are respectively connected to the two second coils balanced during vibration, shapes and sizes of the two second coils in each second coil group should be kept the same, and shapes and sizes of second coils in different second coil groups may be the same or different. In this embodiment of this application, as shown in FIG. 3 to FIG. 5, shapes and sizes of the second coil in the second coil group 310 and the second coil in the second coil group 320 are different. In this embodiment of this application, a region that is in the diaphragm 100 and that is connected to the second coil is referred to as a vibration region. There are at least two vibration regions in the diaphragm 100.

Figure 6A:
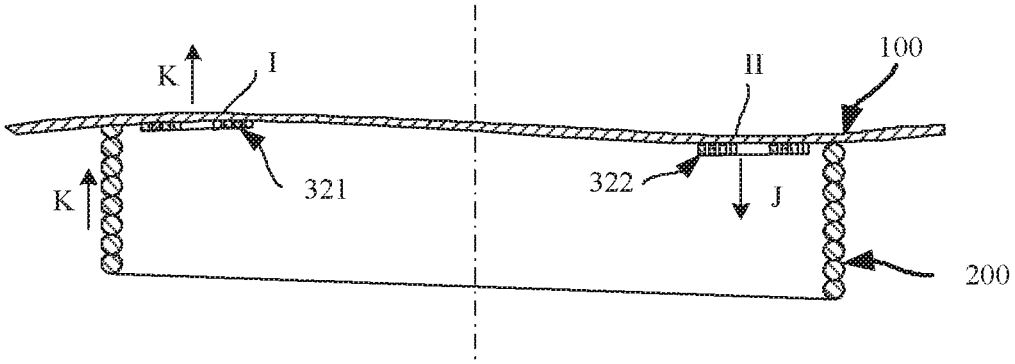
FIG. 6*a* is a schematic structural diagram of a diaphragm when unbalanced vibration occurs in the diaphragm.
Figure 7A:
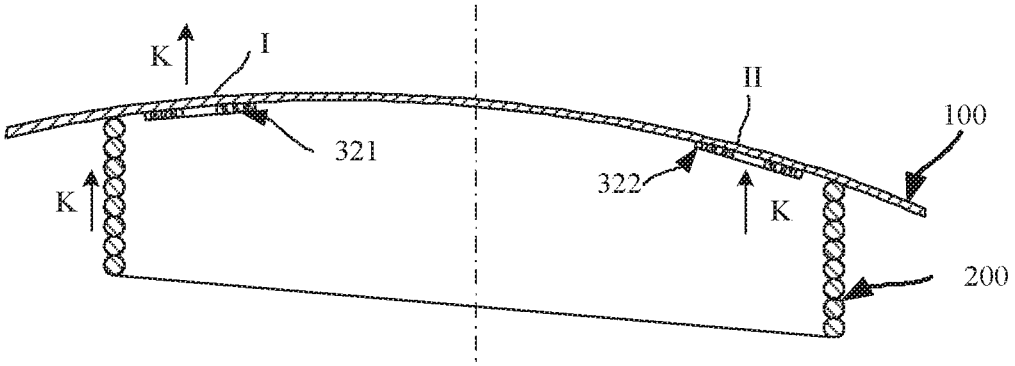
FIG. 7*a* is a schematic structural diagram of a diaphragm when another unbalanced vibration occurs in the diaphragm.

When the diaphragm is driven by the first coil to vibrate, an unbalanced vibration phenomenon may occur. To be specific, magnitudes or sizes of vibration displacements of two vibration regions in the diaphragm that use the center of the diaphragm as a point of symmetry are different. FIG. 6*a* is a schematic structural diagram of the diaphragm 100 when unbalanced vibration occurs in the diaphragm 100. The first coil 200 in FIG. 6*a* moves in a K direction in the figure, a vibration region I that is in the diaphragm 100 and that is connected to the second coil 321 also moves in the K direction, and a vibration region II that is in the diaphragm 100 and that is connected to the other second coil 322 moves in a J direction opposite to the K direction. To be specific, directions of vibration displacements of the vibration region I and the vibration region II are different. A case in which another unbalanced vibration occurs in the diaphragm is shown in FIG. 7*a*. FIG. 7*a* is a schematic structural diagram of the diaphragm 100 when another unbalanced vibration occurs in the diaphragm 100. The first coil 200 in FIG. 7*a* moves in a K direction in the figure, and a vibration region I that is in the diaphragm 100 and that is connected to the second coil 321 and a vibration region II that is in the diaphragm 100 and that is connected to the second coil 322 also move in the K direction. However, a magnitude of a vibration displacement of the vibration region II needs to be less than a magnitude of a vibration displacement of the vibration region I. To be specific, the magnitudes of the vibration displacements of the vibration region I and the vibration region II are different. When a difference between the vibration displacements of the vibration region I and the vibration region II reaches a value, sound emitted by the speaker unit is obviously distorted.

In this embodiment of this application, an unbalanced vibration problem of the diaphragm is alleviated by using the second coil assembly. In a second coil group, when unbalanced vibration occurs in vibration regions that are in the diaphragm and that are correspondingly connected to two second coils, a drive current may be input to one second coil or may be input to both the second coils, to enable the second coils to move and drive the vibration regions that are in the diaphragm and that are correspondingly connected to the second coils to move. A magnitude and a direction of the drive current should be set based on a difference between vibration displacements of the two vibration regions in which the unbalanced vibration occurs, so that the difference between the vibration displacements of the two vibration regions is reduced, thereby reducing a sound distortion degree. During specific implementation, each second coil may be connected to a second coil drive apparatus, and the second coil drive apparatus is configured to input a drive current to the second coil. Specifically, a control apparatus may be integrated into the foregoing first coil drive apparatus, or may be disposed independently of the first coil drive apparatus.

Figure 6B:
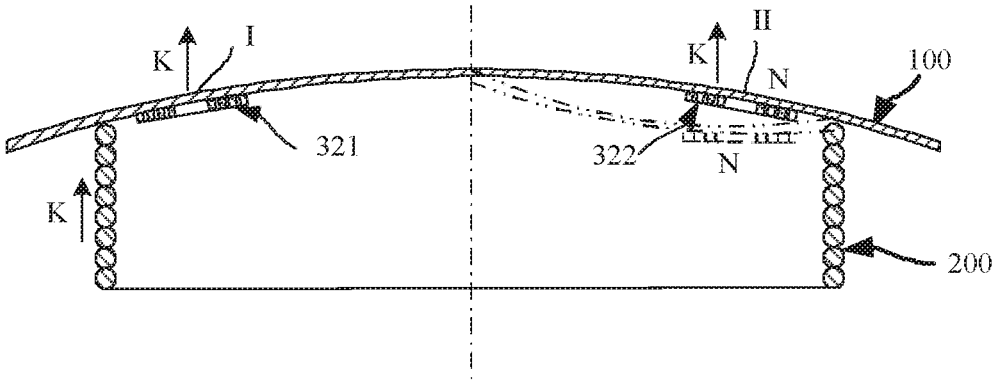
FIG. 6*b* is a schematic structural diagram of a vibration region II shown in FIG. 6*a* when the vibration region II is driven by a second coil to move.

The diaphragm shown in FIG. 6*a* is used as an example. FIG. 6*b* is a schematic structural diagram of the vibration region II shown in FIG. 6*a* when the vibration region II is driven by the second coil to move. The directions of the vibration displacements of the vibration region I and the vibration region II shown in FIG. 6*a* are opposite, and when the first coil 200 moves in the K direction shown in FIG. 6*a*, both the vibration region I and the vibration region II should move in the K direction. Therefore, a drive current needs to be input to the second coil 322, a direction of the drive current should enable the second coil 322 to move in the K direction, to drive the vibration region II to move in the K direction, so that vibration directions of the vibration region I and the vibration region II are the same, and a magnitude of the drive current should enable the vibration region II to move to a location at which the vibration displacement is the same as that of the vibration region I, to reduce unbalanced vibration between the vibration region I and the vibration region II. As shown in FIG. 6*a*, when the vibration region II moves from a location N to a location N', the unbalanced vibration between the vibration region I and the vibration region II is reduced.

Figure 7B:
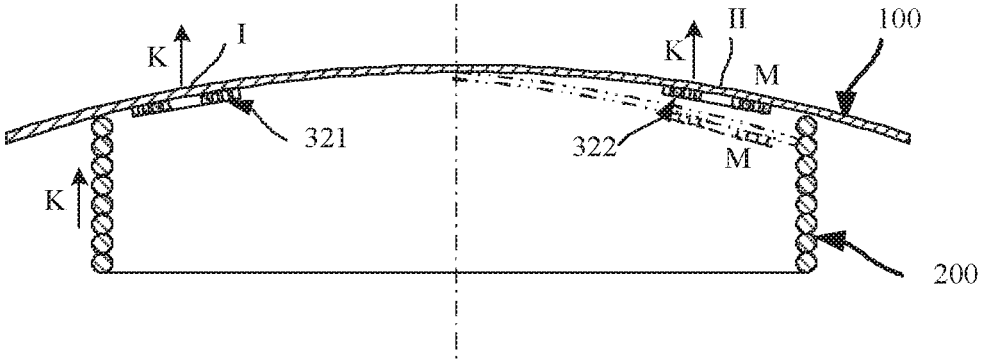
FIG. 7*b* is a schematic structural diagram of a vibration region II shown in FIG. 7*a* when the vibration region II is driven by a second coil to move.

Similarly, FIG. 7*b* is a schematic structural diagram of the vibration region II shown in FIG. 7*a* when the vibration region II is driven by the second coil to move. In FIG. 7*a*, when unbalanced vibration occurs in the vibration region I and the vibration region II in the diaphragm 100, a drive current should be input to the second coil 322 shown in FIG. 7*a*, to enable the vibration region II to move from a location M to a location M' in FIG. 7*b*, to reduce the unbalanced vibration between the vibration region I and the vibration region II.

During vibration of the diaphragm, whether unbalanced vibration occurs in the diaphragm needs to be determined, and locations of vibration regions that are in the diaphragm and in which the unbalanced vibration occurs are determined. When moving in a constant magnetic field, the second coil generates an induced current. If unbalanced vibration does not occur in two vibration regions correspondingly connected to two second coils in one second coil group, magnitudes and directions of vibration displacements of the two vibration regions are kept the same. Therefore, magnitudes and directions of induced currents in the two second coils should be the same. However, when unbalanced vibration occurs in the two vibration regions, induced currents in the two second coils are different in at least one of magnitudes or directions. Specifically, referring to FIG. 6*a*, when the vibration directions of the vibration region I and the vibration region II are different, it can be learned from an induced current determining method that, directions of induced currents generated in the second coil 321 and the second coil 322 are opposite, and magnitudes of the induced currents generated in the second coil 321 and the second coil 322 may be the same or different. Referring to FIG. 7*a*, when the vibration directions of the vibration region I and the vibration region II are the same and amplitudes of vibration are different, directions of induced currents generated in the second coil 321 and the second coil 322 are the same and magnitudes of the induced currents are different. Therefore, when whether the unbalanced vibration occurs in the corresponding vibration regions is determined by using the induced currents in the two second coils, whether the magnitudes and the directions of the induced currents in the two second coils are the same also needs to be determined.

It can be learned based on the foregoing method that, whether unbalanced vibration occurs in the diaphragm and locations of vibration regions in which the unbalanced vibration occurs may be determined by determining whether magnitudes and directions of induced currents generated in two second coils in a same second coil group are the same. During specific implementation, the second coil may further be connected to a detection apparatus, and the detection apparatus is configured to: receive an induced current in the second coil, and determine whether magnitudes and directions of induced currents in two second coils in a second coil group are the same.

Figure 8:
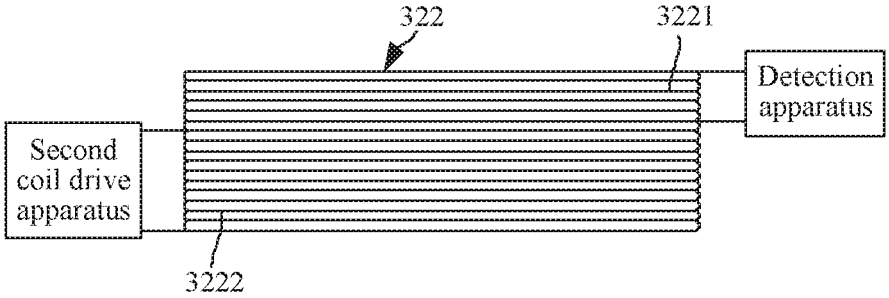
FIG. 8 is a schematic structural diagram of a second coil.

Based on the foregoing method for determining, by using the induced current, whether the diaphragm generates the unbalanced vibration, in a specific implementation, each second coil includes a detection coil and a drive coil. The detection coil is configured to detect at least one of a magnitude or a direction of a vibration displacement of a vibration region connected to the corresponding second coil, and the drive coil is configured to drive the vibration region connected to the corresponding second coil to move. To be specific, a part of the second coil is not used to input the drive current, but is merely used to output the induced current. During specific implementation, a part of each second coil is connected to the detection apparatus to be used as the detection coil, and the other part is connected to the second coil drive apparatus to be used as the drive coil. In each second coil, turns of the detection coil and turns of the drive coil may be the same or different. This is not limited in this embodiment of this application. Referring to FIG. 8, an example in which the second coil is formed by winding a conducting wire is used. FIG. 8 is a schematic structural diagram of a second coil. A detection coil 3221 in the second coil 322 is connected to the detection apparatus. A drive coil 3222 is connected to the second coil driving apparatus.

Figure 9A:
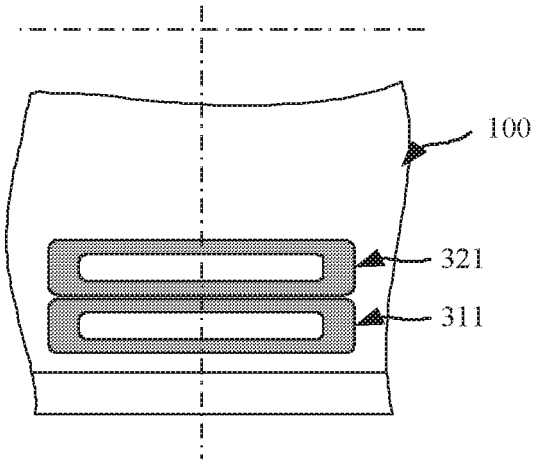
FIG. 9*a* is a schematic partial structural diagram of a diaphragm in a vibration region.
Figure 9B:
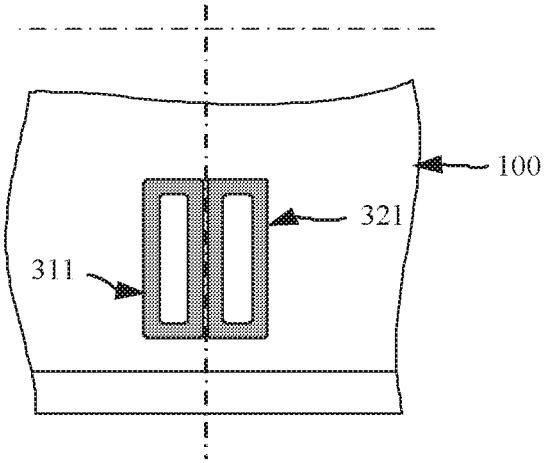
FIG. 9*b* is a schematic partial structural diagram of a diaphragm in a vibration region.
Figure 9C:
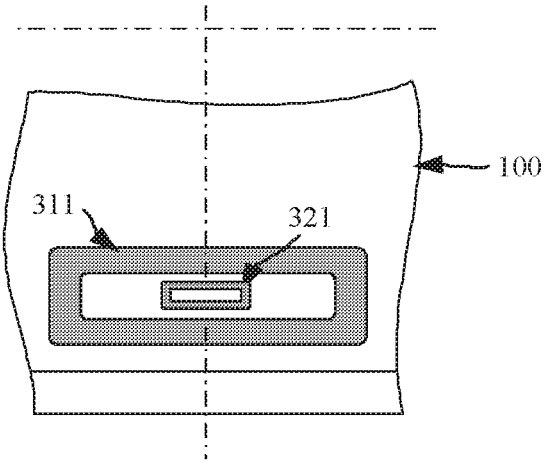
FIG. 9*c* is a schematic partial structural diagram of a diaphragm in a vibration region.

In another specific implementation, when the second coil assembly includes at least two groups of second coils, a coil used to output an induced current and a coil used to input a drive current in the second coil assembly may be separately disposed. To be specific, the detection coil and the drive coil are not located in a same second coil any more. Therefore, some second coils in the second coil group are configured to detect a magnitude or a direction of a vibration displacement of a vibration region correspondingly connected to the second coils, and the other second coils in the second coil group are configured to drive the vibration region correspondingly connected to the second coils to move. Specifically, manners in which the second coils belonging to different second coil groups are disposed are shown in FIG. 9*a* to FIG. 9*c*. FIG. 9*a*. FIG. 9*b*, and FIG. 9*c* are schematic partial structural diagrams of the diaphragm in a vibration region. As shown in FIG. 9*a*, second coils 321 and 311 belonging to two second coil groups are arranged side by side, and an arrangement direction faces a center of the diaphragm. As shown in FIG. 9*b*, second coils 321 and 311 belonging to two second coil groups are arranged side by side, and an arrangement direction is perpendicular to the arrangement direction shown in FIG. 9*a*. As shown in FIG. 9*c*, second coils 321 and 311 belonging to two second coil groups are arranged annually, and the second coil 311 is disposed at the periphery of the second coil 321.

In this embodiment of this application, each second coil may be a flexible conducting layer coil formed on the diaphragm, or may be a coil formed by winding a conducting wire. The flexible conducting layer coil has a thin structure, a lightweight, and flexibility, having relatively small impact on a vibration characteristic of the diaphragm. During specific implementation, a flexible conducting layer of each second coil is formed on the diaphragm by using a flexible circuit board printing process or a micro-processing process.

Figure 10A:
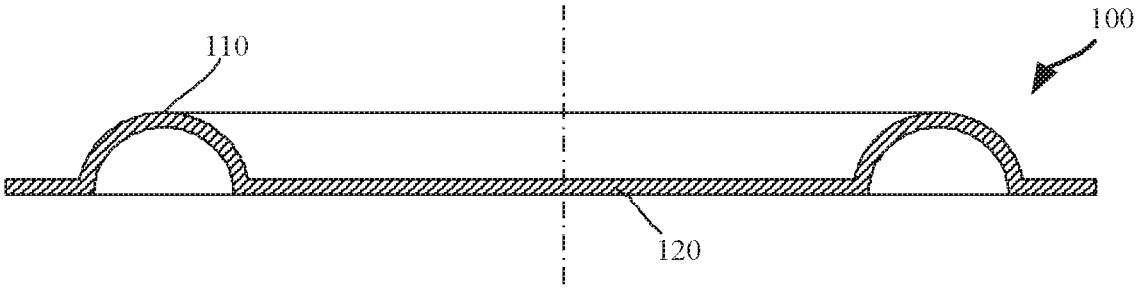
FIG. 10*a* is a schematic sectional structural diagram of a diaphragm according to an embodiment of this application.
Figure 10B:
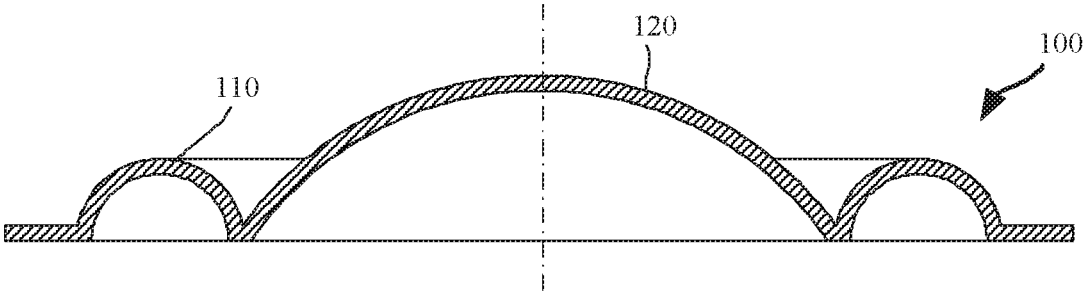
FIG. 10*b* is a schematic sectional structural diagram of a diaphragm according to an embodiment of this application.

To reduce the sound distortion degree of the diaphragm, when the diaphragm vibrates, the diaphragm needs to be kept moving in an axial direction of an axis of symmetry of the diaphragm instead of moving in another direction. Referring to FIG. 5, the diaphragm 100 includes a surround portion 110. A surround (Surround) is a ring-shaped protrusion structure formed on the diaphragm 100, so that rigidity of the diaphragm can be improved, and vibration of the diaphragm can be supported and maintained. Therefore, the diaphragm can move in the axial direction of the axis of symmetry of the diaphragm instead of moving in another direction, and it is also ensured that the first coil moves in the axial direction of the axis of symmetry of the diaphragm. A sectional structure of the diaphragm 100 is shown in FIG. 10*a* and FIG. 10*b*. FIG. 10*a* and FIG. 10*b* are schematic sectional structural diagrams of the diaphragm according to an embodiment of this application.

A part that has the diaphragm and that is in the surround portion is a central portion. As shown in FIG. 10*a*, the central portion 120 has a planar structure. As shown in FIG. 10*b*, the central portion 120 may alternatively have a dome structure. The rigidity of the diaphragm can further be improved by using a dome (Dome).

Figure 11A:
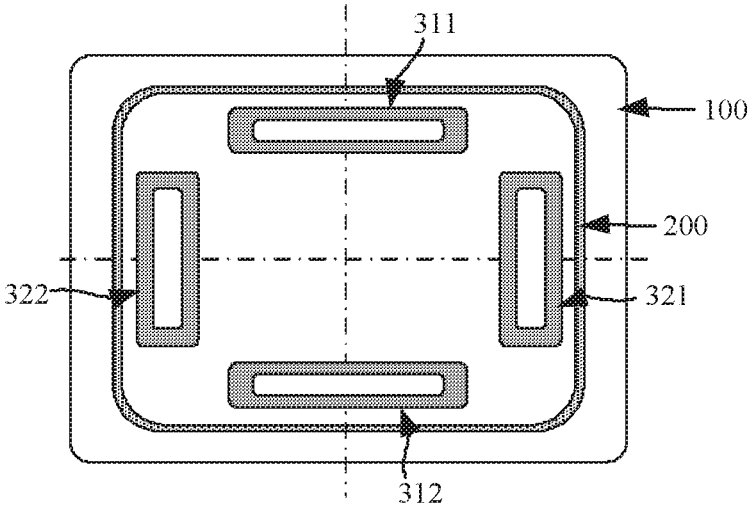
FIG. 11*a* is a schematic diagram of a relative location relationship between a first coil and a plurality of second coils on a diaphragm.
Figure 11B:
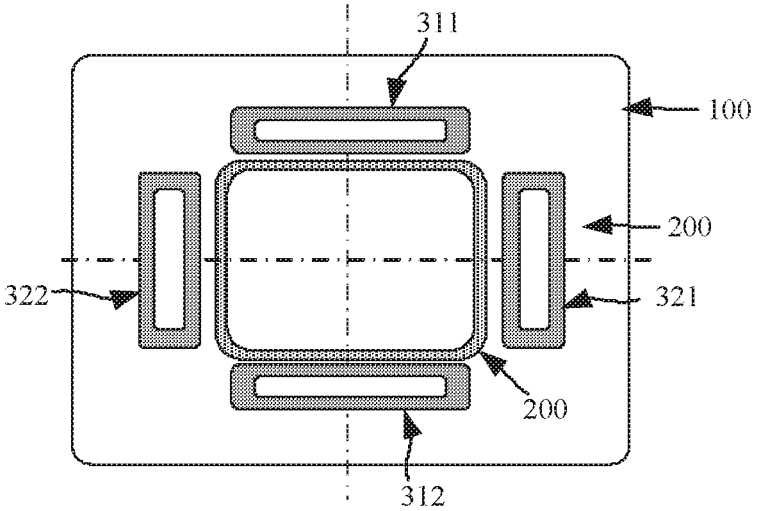
FIG. 11*b* is a schematic diagram of a relative location relationship between a first coil and a plurality of second coils on a diaphragm.
Figure 11C:
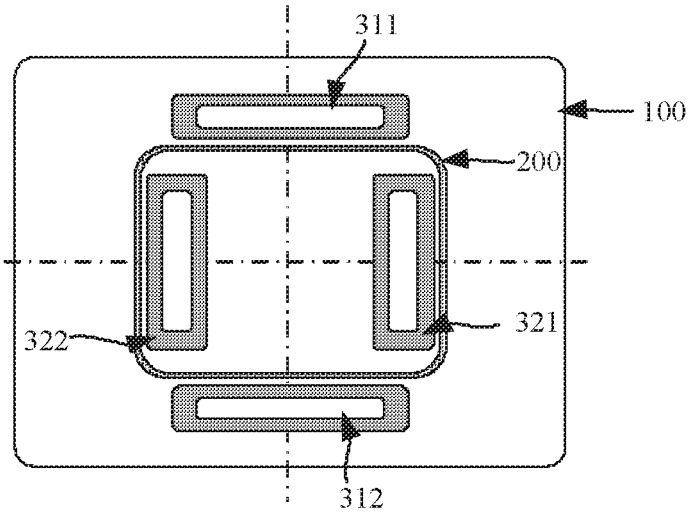
FIG. 11*c* is a schematic diagram of a relative location relationship between a first coil and a plurality of second coils on a diaphragm.

The first coil and each second coil are disposed in the central portion. To reduce impact of the second coil on the vibration characteristic of the diaphragm, in this embodiment of this application, an area of a region enclosed by each second coil is smaller than an area of a region enclosed by the first coil. Relative location setting manners between the first coil and a plurality of second coils are shown in FIG. 11*a* to FIG. 11*c*. FIG. 11*a* to FIG. 11*c* are schematic diagrams of a relative location relationship between the first coil and the plurality of second coils on the diaphragm. As shown in FIG. 11*a*, in the second coil assembly, second coils 311, 312, 321, and 322 are disposed in a region enclosed by the first coil 200. Alternatively, as shown in FIG. 11*b*, in the second coil assembly, second coils 311, 312, 321, and 322 are disposed outside a region enclosed by the first coil 200. Alternatively, as shown in FIG. 11*c*, when the second coil assembly includes two groups of second coils, second coils 321 and 322 in one second coil group are disposed in a region enclosed by the first coil 200, and second coils 311 and 312 in the other second coil group are disposed outside a region enclosed by the first coil 200. When the second coil assembly includes more than two second coil groups, such an arrangement manner may also be used.

Figure 12:
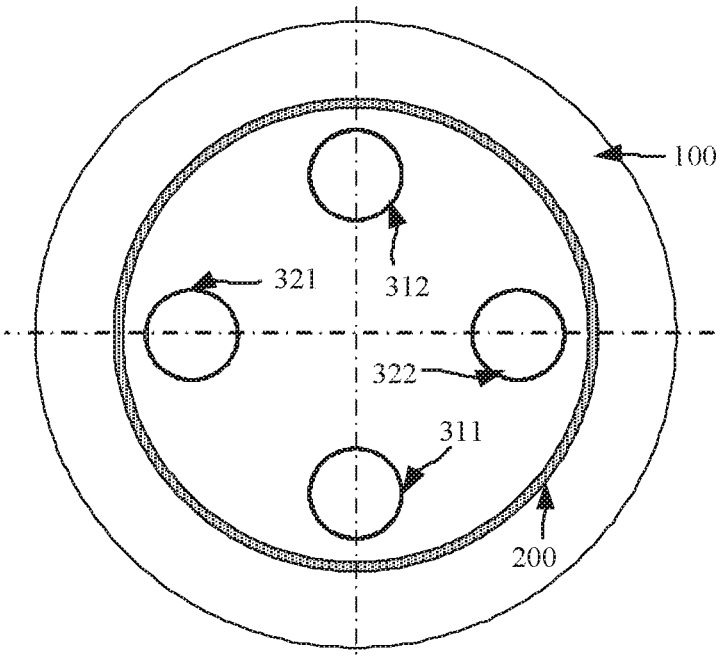
FIG. 12 is a schematic structural diagram of a speaker unit having another structure according to an embodiment of this application.

In addition to a rectangular structure shown in FIG. 5, a shape of the diaphragm may have a circular structure or an elliptical structure. In addition to a rectangular structure shown in FIG. 5, a shape of the first coil and a shape of the second coil may alternatively have circular structures or elliptical structures. FIG. 12 is a schematic structural diagram of a speaker unit having another structure according to an embodiment of this application. In the speaker unit, the diaphragm 100, the first coil 200, and the second coils 311, 312, 321, and 322 all have circular structures.

During specific implementation, a quantity of second coil groups in the second coil assembly should be set based on a size of the diaphragm and areas and a distribution status of regions that are in the diaphragm and in which an unbalanced vibration phenomenon occurs, to enable the second coil to cover the regions that are in the diaphragm and in which the unbalanced vibration phenomenon occurs. To reduce the area of the region enclosed by the second coil and increase the quantity of second coil groups, an area of a vibration region corresponding to each second coil may be reduced, and a quantity of vibration regions corresponding to second coils on the diaphragm may be increased, thereby improving precision of controlling vibration of the diaphragm by using the second coil assembly. Specifically, there may be one to five second coil groups on the diaphragm. Specifically, for example, there is one second coil group, two second coil groups, three second coil groups, four second coil groups, or five second coil groups.

In this embodiment of this application, the magnet may include one or more magnetic members. In a specific implementation, as shown in FIG. 3, the magnet 500 includes a plurality of magnetic members 510. During specific implementation, in addition to a permanent magnet, the magnetic member 510 may be alternatively an electromagnet.

An embodiment of this application further provides a speaker, including the speaker unit provided in the foregoing embodiments. Specifically, the speaker may include one or more speaker units according to the foregoing embodiments. In addition, during specific implementation, the speaker may further include elements such as a housing, a tuning device, and a drive circuit.

A sound distortion problem caused by unbalanced vibration of the diaphragm can also be alleviated by using the speaker. For specific implementations of the speaker, refer to the embodiments of the foregoing speaker unit, and repetitions are not described herein again.

Figure 13:
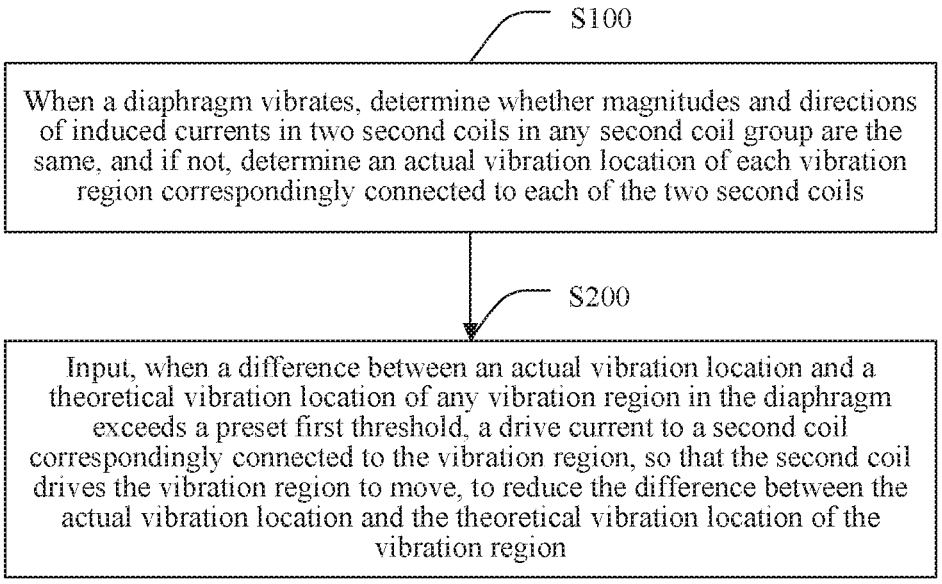
FIG. 13 is a flowchart of a speaker control method according to an embodiment of this application.

An embodiment of this application further provides a speaker control method. The method is applicable to the speaker provided in the foregoing embodiment, to determine whether unbalanced vibration occurs in the diaphragm in the speaker unit, and reduce the unbalanced vibration of the diaphragm. Referring to FIG. 13, the method includes the following steps.

Step S100: When the diaphragm vibrates, determine whether magnitudes and directions of induced currents in two second coils in any second coil group are the same, and if not, determine an actual vibration location of each vibration region correspondingly connected to each of the two second coils.

Specifically, at least one second coil group is disposed on the diaphragm, and two second coils in each second coil group are separately connected to a vibration region in the diaphragm. An actual vibration location of each vibration region may be determined by using a direction and a magnitude of a vibration displacement of the vibration region that deviates from an initial location, and when actual vibration locations of two vibration regions are different and a difference between the actual vibration locations of the two vibration regions exceeds a value, a sound distortion problem is caused.

When the second coil performs a magnetic induction line cutting movement in a constant magnetic field of the magnet, an induced current is generated in the second coil. Therefore, according to a formula of an electromagnetic induction law: $E=n(\Delta\Phi/\Delta t)$ (where E is an induced electromotive force, n is a quantity of coil turns, and $\Delta\Phi/\Delta t$ is a variation of magnetic flux in the coil in a unit time) and $E=-BLV \sin A$ (where E is an induced electromotive force, B is a magnetic field intensity, L is a length of the conductor, V is a conductor speed, and sin A is an angle between the conductor speed and a magnetic induction line), when a magnitude of the induced current in the second coil is known, because the constant magnetic field generated by the magnet in the speaker unit is a non-uniform magnetic field, in each second coil, magnitudes of magnetic flux at all locations in a movement path of vibration of the second coil are different. Magnetic field intensity distribution of the constant magnetic field may be determined by using an experiment or the like. Therefore, when the second coil is at any location during the vibration, a magnitude of magnetic flux in the second coil may be determined. Therefore, magnetic flux in the second coil corresponding to the induced current may be determined according to the formula of the electromagnetic induction law based on the magnitude of the induced current in the second coil, and then a specific location corresponding to the magnetic flux is determined based on the magnetic field intensity distribution of the constant magnetic field, so that the magnitude of the vibration displacement of the vibration region that is correspondingly connected to the second coil and that deviates from the initial location may be determined. Similarly, when the second coil vibrates in different directions in the magnetic field, directions of induced currents generated in the second coil are also different. The movement direction of the second coil in the magnetic field may be determined based on the direction of the induced current in the second coil and in combination with the formula of the electromagnetic induction law and the magnetic field intensity distribution of the constant magnetic field, so that the direction of the vibration displacement of the vibration region that is correspondingly connected to the second coil and that deviates from the initial location may be determined. The actual vibration location of the vibration region may be determined by combining the magnitude and the direction of the vibration displacement of the vibration region.

According to the foregoing method, in a specific implementation, when step S100 is performed, the determining an actual vibration location of each vibration region correspondingly connected to each of the two second coils specifically includes the following steps:

determining a magnitude of a vibration displacement of each vibration region based on the magnitude of the induced current in the second coil correspondingly connected to the vibration region;

determining a direction of the vibration displacement of each vibration region based on the direction of the induced current in the second coil correspondingly connected to the vibration region; and determining the actual vibration location of each vibration region based on the magnitude and the direction of the vibration displacement of the vibration region.

Specifically, the determining a magnitude of a vibration displacement of each vibration region based on the magnitude of the induced current in the second coil correspondingly connected to the vibration region includes:

determining a variation of magnetic flux in any second coil based on a magnitude of an induced current in the second coil, where specifically, after the magnitude of the induced current in the second coil is determined according to the formula $E=n(\Delta\Phi/\Delta t)$, the variation of the magnetic flux in the second coil may be determined;

determining a displacement amount of the second coil based on the variation of the magnetic flux in the second coil and magnetic field intensity distribution of a magnetic field in which the second coil is located, where during specific implementation, the magnetic field intensity distribution of the magnetic field in which the second coil is located may be detected based on an experiment, so that magnetic flux at each location in a path of each second coil during vibration may be determined, and the displacement amount of the second coil may be determined based on the variation of the magnetic flux in the second coil; and determining, based on the displacement amount of the second coil, the magnitude of the vibration displacement of the vibration region correspondingly connected to the second coil.

Specifically, the determining a direction of the vibration displacement of each vibration region based on the direction of the induced current in the second coil correspondingly connected to the vibration region specifically includes:

determining a speed direction of any second coil based on a direction of an induced current in the second coil and magnetic field intensity distribution of a magnetic field in which the second coil is located, where during specific implementation, the magnetic field intensity distribution of the magnetic field in which the second coil is located may be determined based on an experiment, and after the direction of the current in the second coil is determined, the speed direction of the second coil may be determined according to the formula E=−BLV sin A; and determining, based on the speed direction of the second coil, a direction of a vibration displacement of a vibration region correspondingly connected to the second coil.

During specific implementation, the foregoing method for detecting, by using the induced current, whether unbalanced vibration occurs in the diaphragm may be implemented by using the detection apparatus in the foregoing embodiments. Specifically, the detection apparatus may be a processor disposed in the speaker. Alternatively, when the speaker is disposed in a terminal, the detection apparatus may be alternatively a processor in the terminal. In each second coil, the detection coil is connected to the detection apparatus. The detection apparatus is configured to: receive an induced current in the second coil, and when determining that magnitudes or directions of induced currents in two second coils in a same second coil group are different, determine that an unbalanced vibration phenomenon occurs in vibration regions that are in the diaphragm and that are correspondingly connected to the two second coils.

The constant magnetic field generated by the magnet in the speaker unit is a non-uniform magnetic field, so that in each second coil, magnitudes of induced currents generated at all locations in a movement path of the second coil are different. Therefore, in addition to the foregoing method for determining an actual vibration location of the second coil by using a magnetic flux change, the actual vibration location of the second coil may be alternatively directly determined by using the magnitude of the induced current in the second coil, to determine the actual vibration location of the vibration region correspondingly connected to the second coil. During specific implementation, the magnitudes of the induced currents at all the locations in the movement path of each second coil when the diaphragm vibrates may be determined by using a test in advance, and the magnitudes of the induced currents corresponding to all the locations in the movement path of each second coil are stored in the detection apparatus. After receiving the induced current in any second coil, the actual vibration location of the second coil may be determined by searching a correspondence between the induced current and the movement location.

When it is detected that magnitudes or directions of induced currents in two second coils in a same second coil group are different, it may be determined that an unbalanced vibration phenomenon occurs in two vibration regions correspondingly connected to the two second coils. When the unbalanced vibration phenomenon is slight, a sound distortion problem audible to the human ear does not occur in the diaphragm. In this case, vibration of the two vibration regions does not need to be corrected. However, when the unbalanced vibration phenomenon is relatively severe to cause an audible sound distortion problem, the vibration of the two vibration regions needs to be corrected. Therefore, after it is determined that the unbalanced vibration phenomenon occurs in the two vibration regions, a magnitude of the unbalanced vibration further needs to be determined, to determine whether the vibration of the vibration regions needs to be corrected. Therefore, after step S100, the method further includes the following step:

Step S200: Input, when a difference between an actual vibration location and a theoretical vibration location of any vibration region in the diaphragm exceeds a preset first threshold, a drive current to a second coil correspondingly connected to the vibration region, so that the second coil drives the vibration region to move, to reduce the difference between the actual vibration location and the theoretical vibration location of the vibration region.

The theoretical vibration location is a vibration location of each vibration region when the diaphragm is driven by the first coil to vibrate and a difference between vibration displacements of two vibration regions respectively correspondingly connected to two second coils in any second coil group does not exceed a preset second threshold.

Specifically, when the corresponding unbalanced vibration occurs in two vibration regions, a deviation occurs between an actual vibration location and a theoretical vibration location of at least one of the two vibration regions. In this embodiment of this application, the theoretical vibration location is defined as a location of each vibration region during vibration of the diaphragm when unbalanced vibration does not occur in two mutually corresponding vibration regions or a degree of unbalanced vibration of two mutually corresponding vibration regions is relatively small and is insufficient to cause a sound distortion problem. After a difference between vibration displacements of the two mutually corresponding vibration regions reaches a degree, the sound distortion problem is caused. In this embodiment, when the sound distortion problem occurs in the diaphragm, a difference between vibration displacements of two vibration regions respectively correspondingly connected to two second coils in a same second coil group is defined as the second threshold.

During specific implementation, a magnitude of the second threshold may be determined by using an experimental test, and theoretical vibration locations of all the vibration regions in the diaphragm may also be determined by using an experimental test. When the diaphragm is driven by the first coil to vibrate, during emission of sound having different frequencies, vibration frequencies of the diaphragm are also different. Therefore, the theoretical vibration locations of all the vibration regions in the diaphragm are also different. When the theoretical vibration location of each vibration region is tested by using an experiment, locations of the vibration regions at different vibration frequencies of the diaphragm are tested. The vibration frequency of the diaphragm is directly related to an audio signal input to the first coil. Therefore, a correspondence between the audio signal in the first coil and the theoretical vibration location of each vibration region in the diaphragm may be established. The actual vibration location of each vibration region may be determined by detecting the induced current in the second coil correspondingly connected to the vibration region, and the theoretical vibration location of each vibration region may be determined by using the audio signal in the first coil. A deviation between the theoretical vibration location and the actual vibration location of each vibration region may be determined by comparing the theoretical vibration location with the actual vibration location of the vibration region.

After the deviation between the actual vibration location and the theoretical vibration location of each vibration region reaches a degree, the distortion problem of sound generated by the diaphragm is caused. In this embodiment of this application, when the sound distortion problem occurs in the diaphragm, a difference between an actual vibration location and a theoretical vibration location of a vibration region is defined as the first threshold. During specific implementation, a value of the first threshold may be alternatively determined by using an experimental test. Specifically, during the test, in the diaphragm at different vibration frequencies, first thresholds corresponding to the vibration frequencies when the sound distortion problem occurs in each vibration region need to be determined.

When unbalanced vibration occurs in two vibration regions, it may be determined that there is an offset between an actual vibration location and a theoretical vibration location of at least one of the vibration regions. Therefore, to correct the offset of the vibration region, a drive current needs to be input to a second coil correspondingly connected to the vibration region, so that the second coil drives the vibration region to move from the actual vibration location to the theoretical vibration location, to reduce a difference between the actual vibration location and the theoretical vibration location of the vibration region, to be specific, to reduce a difference between vibration displacements of the two vibration regions, thereby reducing a sound distortion degree of the speaker. Referring to FIG. 6*b* and FIG. 7*b*, in FIG. 6*b*, the location N is the actual vibration location, and the location N' is the theoretical vibration location. In FIG. 6*b*, the location M is the actual vibration location, and the location M' is the theoretical vibration location.

When the drive current is input to the second coil, a magnitude and a direction of the drive current need to be determined based on an offset direction and an offset distance by which the actual vibration location of the vibration region deviates from the theoretical vibration location of the vibration region. Specifically, after the theoretical vibration location and the actual vibration location of the vibration region are determined, the offset direction and the offset distance by which the actual vibration location is offset from the theoretical vibration location may be determined.

The drive current input to the second coil should enable the vibration region to move from the theoretical vibration location of the vibration region to the actual vibration location within a time. The time in which the vibration region moves from the theoretical vibration location of the vibration region to the actual vibration location should ensure that the unbalanced vibration is immediately corrected upon occurrence, so that sound distortion does not occur. During specific implementation, the time may be determined by using an experimental test. The direction of the drive current should enable the vibration region to move from the theoretical vibration location of the vibration region to the actual vibration location.

After determining the offset distance and the offset direction in which the actual vibration location deviates from the theoretical vibration location, and the time in which the vibration region moves from the theoretical vibration location of the vibration region to the actual vibration location, the magnitude and the direction of the drive current input to the second coil correspondingly connected to the vibration region may be determined. The direction of the drive current may be determined according to a left-hand rule, to enable the vibration region to move from the theoretical vibration location of the vibration region to the actual vibration location. The magnitude of the drive current may be determined according to an Ampere's force formula $F=ILB \sin \alpha$ (where F is an Ampere's force, I is a magnitude of a current in a conductor, L is a length of the conductor, B is a magnetic field intensity, and $\alpha$ is an angle between a current direction and a magnetic field direction). After the drive current is input to the second coil, whether the corresponding vibration region moves to the theoretical vibration location of the vibration region may be determined by detecting the induced current in the second coil.

According to the foregoing method, step S200 further includes:

determining, based on a magnitude of an offset between the actual vibration location and the preset theoretical vibration location of the vibration region, a magnitude of the drive current input to the second coil correspondingly connected to the vibration region, where the magnitude of the drive current should enable the vibration region to move from the theoretical vibration location of the vibration region to the actual vibration location within a time, to reduce unbalanced vibration, and reduce sound distortion, and determining, based on a direction of the offset between the actual vibration location and the preset theoretical vibration location of the vibration region, a direction of the drive current input to the second coil correspondingly connected to the vibration region, where the direction of the drive current should enable the vibration region to move from the theoretical vibration location of the vibration region to the actual vibration location.

During specific implementation, the foregoing method for detecting whether the actual vibration location of each vibration region deviates from the theoretical vibration location may be implemented by using the detection apparatus in the foregoing embodiments, and the magnitude and the direction of the drive current input to the second coil may be determined by using the second coil drive apparatus in the foregoing embodiments.

A process and a principle of the speaker control method provided in the embodiments of this application are described below with reference to a specific use scenario.

Figure 14:
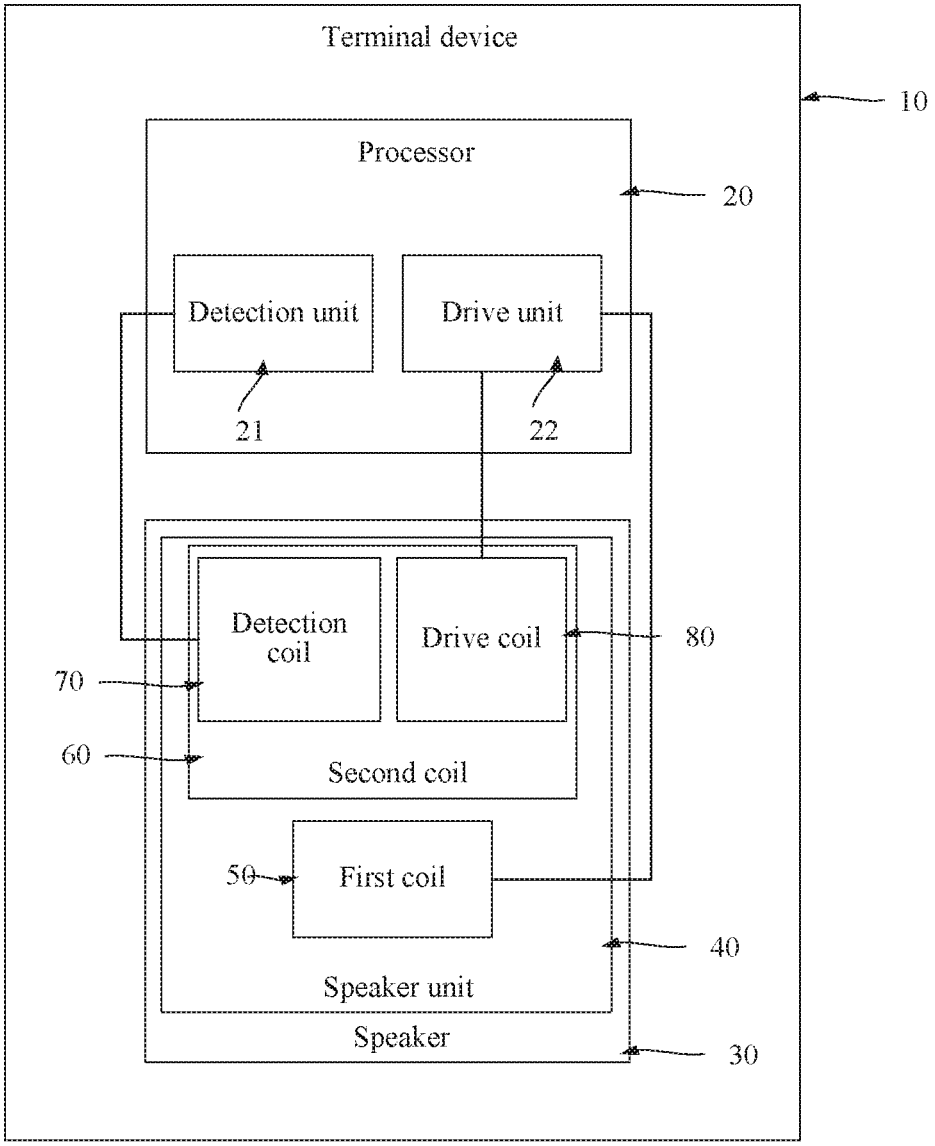
FIG. 14 is a schematic structural diagram of a terminal device according to an embodiment of this application.

In the use scenario, a speaker is disposed in a terminal device. The terminal device is a mobile phone, or may be a tablet computer, a notebook computer, or the like. A structure of a speaker unit in the speaker is shown in FIG. 5. The speaker unit includes two second coil groups. Each second coil group includes two second coils. Each second coil includes a detection coil and a drive coil. FIG. 14 is a schematic structural diagram of the terminal device. The terminal device 10 includes a processor 20 and a speaker 30. The speaker 30 includes a speaker unit 40. A first coil 50 and each second coil 60 in the speaker unit 40 are connected to the processor 20, and the processor 20 is used as a control apparatus of the speaker 30.

The processor 20 includes a drive unit 22 and a detection unit 21. The first coil 50 and a drive coil 80 in each second coil 60 are connected to the drive unit 22. A detection coil 70 in each second coil 60 is connected to the detection unit 21.

Figure 15:
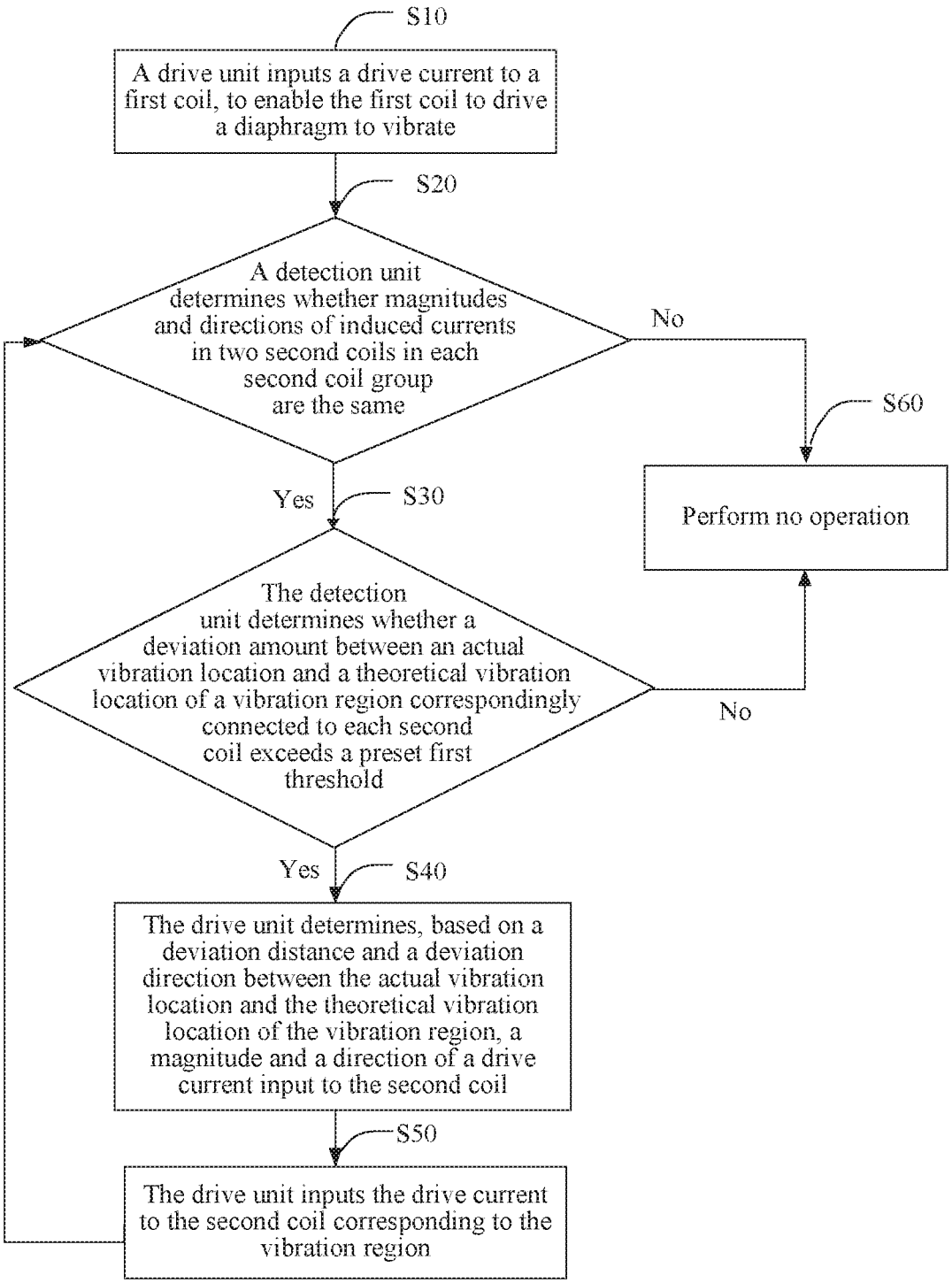
FIG. 15 is a flowchart of a speaker control method according to an embodiment of this application.

An implementation procedure of the speaker control method is shown in FIG. 15, and the implementation procedure includes the following steps.

Step S10: The drive unit inputs a drive current to the first coil, to enable the first coil to drive a diaphragm to vibrate.

Step S20: The detection unit determines whether magnitudes and directions of induced currents in two second coils in each second coil group are the same, and if yes, perform step S60, or if not, perform step S30.

Step S30: The detection unit determines whether a deviation amount between an actual vibration location and a theoretical vibration of a vibration region correspondingly connected to each second coil exceeds a preset first threshold. Theoretical vibration locations and first thresholds of each vibration region at different vibration frequencies are preset in the detection unit. The detection unit determines the actual vibration location of each vibration region based on the magnitude and the direction of the induced current in each second coil, and then compares the actual vibration location of each vibration region with the theoretical vibration location of the vibration region at a current vibration frequency, to determine whether the deviation amount between the actual vibration location and the theoretical vibration location of the vibration region exceeds the first threshold.

Step S40: The drive unit determines, based on a deviation distance and a deviation direction between the actual vibration location and the theoretical vibration location of the vibration region, a magnitude and a direction of a drive current input to the second coil. The drive unit determines the magnitude of the drive current based on the distance by which the actual vibration location of the vibration region deviates from the theoretical vibration location; and determines the direction of the drive current based on the distance direction in which the actual vibration location of the vibration region deviates from the theoretical vibration location.

Step S50: The drive unit inputs the drive current to the second coil corresponding to the vibration region, and perform step S20 repeatedly. Specifically, the drive current is input to the second coil to enable the second coil to drive the vibration region correspondingly connected to the second coil to move, to reduce the deviation amount between the actual vibration location and the theoretical vibration location of the vibration region.

Step S60: Perform no operation.

According to the foregoing control method, when unbalanced vibration occurs in the diaphragm of the speaker, real-time correction may be performed on vibration regions in which the unbalanced vibration occurs, to alleviate the unbalanced vibration problem, thereby reducing the sound distortion degree of the speaker.

It should be noted that in the embodiments of this application, the module division is an example, and is merely logical function division, and there may be other division in actual applications. Functional units in the embodiments of this application may be integrated into one processing unit, or each of the units may exist alone physically, or two or more units are integrated into one unit. The integrated unit may be implemented in a form of hardware, or may be implemented in a form of a software functional unit.

When the integrated unit is implemented in the form of a software functional unit and sold or used as an independent product, the integrated unit may be stored in a computer readable storage medium. Based on such an understanding, the technical solutions of this application essentially, or the part contributing to the prior art, or all or some of the technical solutions may be implemented in a form of a software product. The software product is stored in a storage medium and includes several instructions for instructing a computer device (which may be a personal computer, a server, a network device, or the like) or a processor (processor) to perform all or some of the steps of the methods described in the embodiments of this application. The foregoing storage medium includes: any medium that can store program code, such as a USB flash drive, a removable hard disk, a read-only memory (Read-Only Memory, ROM), a random access memory (Random Access Memory, RAM), a magnetic disk, or an optical disc.

Based on the foregoing embodiments, an embodiment of this application provides a computer readable storage medium, including an instruction, and when the instruction is run on a computer, the computer is enabled to perform the speaker control method according to the foregoing embodiments.

Based on the foregoing embodiments, this application provides a computer program product including an instruction, and when the instruction is run on a computer, the computer is enabled to perform the speaker control method according to the foregoing embodiments.

An embodiment of this application further provides a terminal, including the speaker according to the foregoing embodiments. During specific implementation, the terminal may be a terminal device such as a mobile phone, a tablet computer, or a notebook computer. One or more speakers may be disposed in the terminal.

In a possible implementation, a structure of the terminal is shown in FIG. 14. The terminal device 10 includes the processor 20 and the speaker 30. The speaker 30 includes the speaker unit 40. The first coil 50 and each second coil 60 in the speaker unit 40 are connected to the processor 20. The processor 20 is used as a control apparatus of the speaker 30. The processor 20 includes the drive unit 22 and the detection unit 21. The first coil 50 and the drive coil 80 in each second coil 60 are connected to the drive unit 22. The detection coil 70 in each second coil 60 is connected to the detection unit 21.

Figure 16:
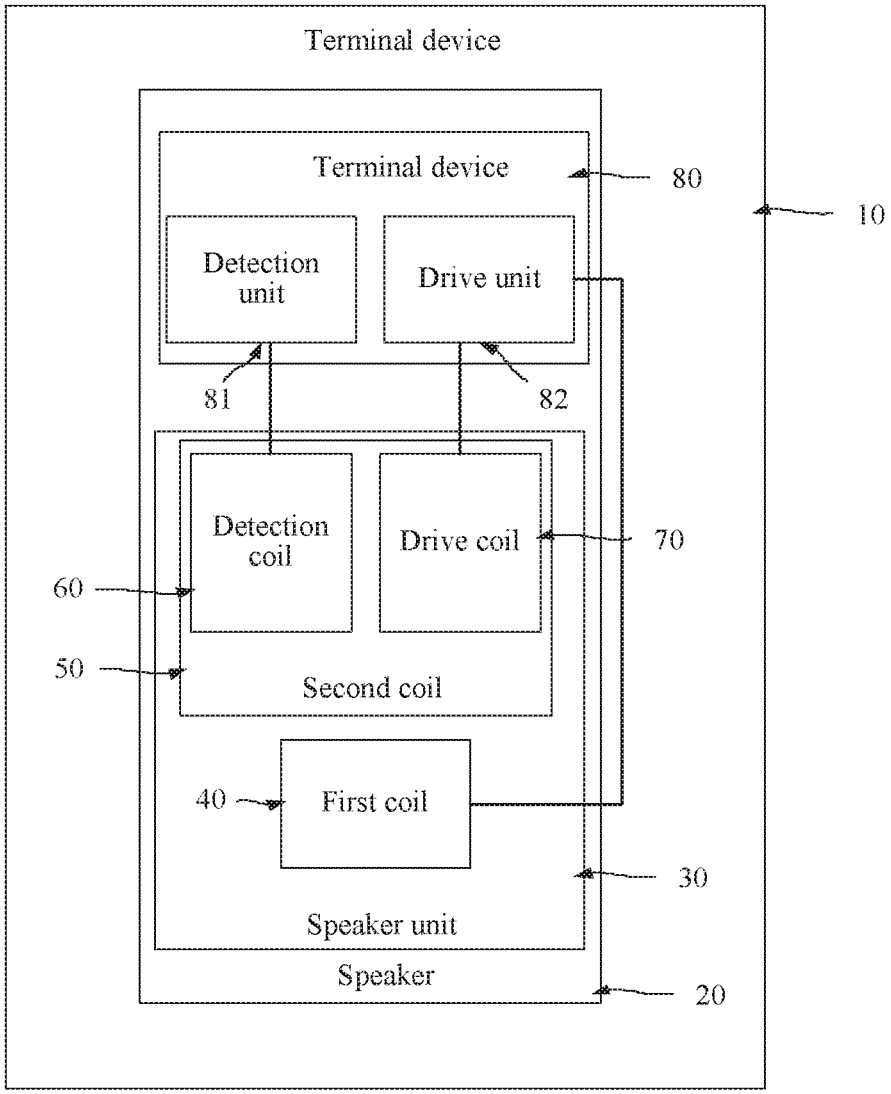
FIG. 16 is a schematic structural diagram of a terminal device according to an embodiment of this application.

In another possible implementation, the speaker includes a control apparatus. In this case, a structure of the terminal is shown in FIG. 16, the control apparatus 80 is disposed in the speaker 20, and the control apparatus 80 includes a drive unit 82 and a detection unit 81. A first coil 40 and a drive coil 70 in each second coil 50 are connected to the drive unit 82. A detection coil 60 in each second coil 50 is connected to the detection unit 81.

A sound distortion problem caused by unbalanced vibration of the diaphragm of the speaker can also be alleviated by using the terminal. For specific implementations, refer to the embodiments of the foregoing speaker unit, and repetitions are not described herein again.

In conclusion, the speaker unit provided in the embodiments of this application includes the first coil and the second coil assembly, the second coil assembly includes the at least one second coil group, each second coil group includes two second coils, and the first coil and each second coil are connected to the diaphragm. When the diaphragm is driven by the first coil to vibrate, and unbalanced vibration is caused due to unbalanced atmospheric pressure and the like. In at least one second coil group in regions that are in the diaphragm and in which the unbalanced vibration occurs, if a difference between vibration displacements of the two vibration regions correspondingly connected to two second coils exceeds a preset threshold, the second coil in the second coil group may drive at least one of the two vibration regions to move, to reduce the difference between the vibration displacements of the two vibration regions, so that the vibration displacements of the two vibration regions tend to be consistent, and the unbalanced vibration of the diaphragm is reduced, thereby alleviating the sound distortion problem of the speaker that is caused by the unbalanced vibration, and improving use experience of a user.

A person skilled in the art should understand that the embodiments of this application may be provided as a method, a system, or a computer program product. Therefore, this application may use a form of hardware only embodiments, software only embodiments, or embodiments with a combination of software and hardware. Moreover, this application may use a form of a computer program product that is implemented on one or more computer-usable storage media (including but not limited to a disk memory, a CD-ROM, an optical memory, and the like) that include computer usable program code.

This application is described with reference to the flowcharts and/or block diagrams of the method, the device (system), and the computer program product according to the embodiments of this application. It should be understood that computer program instructions may be used to implement each process and/or each block in the flowcharts and/or the block diagrams and a combination of a process and/or a block in the flowcharts and/or the block diagrams. These computer program instructions may be provided to a general-purpose computer, a dedicated computer, an embedded processor, or a processor of another programmable data processing device to generate a machine, so that the instructions executed by the computer or the processor of the another programmable data processing device generate an apparatus for implementing a specified function in one or more processes in the flowcharts and/or in one or more blocks in the block diagrams.

These computer program instructions may also be stored in a computer readable memory that can instruct the computer or the another programmable data processing device to work in a specific manner, so that the instructions stored in the computer readable memory generate an artifact that includes an instruction apparatus. The instruction apparatus implements a specified function in one or more processes in the flowcharts and/or in one or more blocks in the block diagrams.

These computer program instructions may also be loaded onto the computer or the another programmable data processing device, so that a series of operations and steps are performed on the computer or the another programmable device, thereby generating computer-implemented processing. Therefore, the instructions executed on the computer or the another programmable device provide steps for implementing a specified function in one or more processes in the flowcharts and/or in one or more blocks in the block diagrams.

Obviously, a person skilled in the art can make various modifications and variations to the embodiments of this application without departing from the spirit and scope of the embodiments of the present invention. This application is intended to cover these modifications and variations provided that they fall within the scope of protection defined by the following claims and their equivalent technologies.

What is claimed is:

1. A speaker comprising:

a frame;

a magnet coupled to the frame;

a diaphragm coupled to the frame;

a first coil coupled to the diaphragm and configured to drive the diaphragm to vibrate to generate sound; and a second coil assembly disposed to parallel to the first coil, wherein the second coil assembly comprises at least one second coil group, wherein each of the at least one second coil group is coupled to the diaphragm and comprises two second coils, wherein the two second coils in each of the at least one second coil group are distributed symmetrically around a center of the diaphragm using the center of the diaphragm as a center of symmetry, wherein all second coils in the second coil assembly are evenly distributed around the center of the diaphragm, and wherein the second coil assembly is configured to adjust a vibration of the diaphragm when the first coil drives the diaphragm to perform unbalanced vibration.

2. The speaker of claim 1, further comprising a sound emission hole, wherein an opening direction of the sound emission hole is parallel to a plane in which the diaphragm lies.

3. The speaker of claim 1, wherein each second coil in the second coil assembly comprises a detection coil and a drive coil, wherein the detection coil is configured to output an induced current to detect at least one of a magnitude or a direction of a vibration displacement of a corresponding vibration region, wherein the drive coil is configured to input a drive current to drive the corresponding vibration region to move, and wherein the corresponding vibration region is in the diaphragm and coupled to a corresponding second coil in the second coil assembly.

4. The speaker of claim 3, wherein each second coil in the second coil assembly is a flexible conducting layer coil formed on the diaphragm.

5. The speaker of claim 3, wherein each second coil in the second coil assembly is formed by winding a conducting wire.

6. The speaker of claim 1, wherein the diaphragm comprises a surround portion and a central portion located in the surround portion, and wherein the first coil and each second coil in the second coil assembly are disposed in the central portion.

7. The speaker of claim 6, wherein each second coil in the second coil assembly is disposed in a region enclosed by the first coil.

8. The speaker of claim 6, wherein the central portion has a planar structure or a dome structure.

9. The speaker of claim 6, wherein the diaphragm has a first circular structure, a first rectangular structure, or a first elliptical structure, wherein the first coil has a second circular structure, a second rectangular structure, or a second elliptical structure, and wherein each second coil in the second coil assembly has a third circular structure, a third rectangular structure, or a third elliptical structure.

10. The speaker of claim 1, wherein an area of a region enclosed by each second coil in the second coil assembly is less than an area of a region enclosed by the first coil.

11. An electronic device comprising:

a speaker comprising:

a frame;

a magnet coupled to the frame;

a diaphragm coupled to the frame;

a first coil coupled to the diaphragm and configured to drive the diaphragm to vibrate to generate sound; and a second coil assembly disposed to parallel to the first coil, wherein the second coil assembly comprises at least one second coil group, wherein each of the at least one second coil group is coupled to the diaphragm and comprises two second coils, wherein the two second coils in each of the at least one second coil group are distributed symmetrically around a center of the diaphragm using the center of the diaphragm as a center of symmetry, wherein all second coils in the second coil assembly are evenly distributed around the center of the diaphragm, and wherein the second coil assembly is configured to adjust a vibration of the diaphragm when the first coil drives the diaphragm to perform unbalanced vibration.

12. The electronic device of claim 11, wherein the speaker further comprises a sound emission hole, and wherein an opening direction of the sound emission hole is parallel to a plane in which the diaphragm lies.

13. The electronic device of claim 11, wherein each second coil in the second coil assembly comprises a detection coil and a drive coil, wherein the detection coil is configured to output an induced current to detect at least one of a magnitude or a direction of a vibration displacement of a corresponding vibration region, wherein the drive coil is configured to input a drive current to drive the corresponding vibration region to move, and wherein the corresponding vibration region is in the diaphragm and is coupled to a corresponding second coil in the second coil assembly.

14. The electronic device of claim 13, wherein each second coil in the second coil assembly is a flexible conducting layer coil formed on the diaphragm.

15. The electronic device of claim 13, wherein each second coil in the second coil assembly is formed by winding a conducting wire.

16. The electronic device of claim 11, wherein the diaphragm comprises a surround portion and a central portion located in the surround portion, and wherein the first coil and each second coil in the second coil assembly are disposed in the central portion.

17. The electronic device of claim 16, wherein each second coil in the second coil assembly is disposed in a region enclosed by the first coil.

18. The electronic device of claim 16, wherein the central portion has a planar structure or a dome structure.

19. The electronic device of claim 16, wherein the diaphragm has a first circular structure, a first rectangular structure, or a first elliptical structure, wherein the first coil has a second circular structure, a second rectangular structure, or a second elliptical structure, and wherein each second coil in the second coil assembly has a third circular structure, a third rectangular structure, or third elliptical structure.

20. The electronic device of claim 11, wherein the second coil assembly comprises one to five second coil groups.

* * * * *